US005756909A

United States Patent [19]

Liimatainen et al.

[11] Patent Number: 5,756,909

[45] Date of Patent: May 26, 1998

[54] ABRASION RESISTANT, DUCTILE STEEL

[75] Inventors: Jari Ilmari Liimatainen; Mikko Aimo Antero Kumpula, both of Tampere, Finland

[73] Assignee: Rauma Materials Technologies, OY, Tampere, Finland

[21] Appl. No.: 782,640

[22] Filed: Jan. 14, 1997

[30] Foreign Application Priority Data

Jan. 22, 1996 [FI] Finland ..... 960299

[51] Int. Cl.[6] ..... C22C 33/02

[52] U.S. Cl. ..... 75/238; 75/239; 75/240; 75/246

[58] Field of Search ..... 75/246, 243, 244, 75/238–240; 419/49, 11

[56] References Cited

U.S. PATENT DOCUMENTS

| | | | |
|---|---|---|---|
| 4,384,053 | 5/1983 | Peilloud et al. | 523/153 |
| 4,491,558 | 1/1985 | Gardner | 419/23 |
| 5,108,493 | 4/1992 | Causton | 75/255 |
| 5,217,683 | 6/1993 | Causton | 419/38 |
| 5,529,600 | 6/1996 | Fernandez et al. | 75/228 |

OTHER PUBLICATIONS

Substitution of Iron Manganese Alloy for Cobalt as the Binder Phase in Cemented Carbides, *International Conference on Advances in Hard Materials Production*, J.D. Bolton et al., (1992), pp. 21–1 to 21–15.

"Kinetika Spekaniya Karbida Titana so Stalyu Gadfilda", *Poroshkova Metallurgia*, O.V. Jablokova and S.N. Kulkov, vol. 7, pp. 13–16, (1990).

"High Strength Sintered Manganese Steel", *Modern Developments in Powder Metallurgy*, A. Šalak, vol. 13, pp. 183–201.

"Limitations and Possibilities in the Utilization of Cr and Mn as Alloying Elements in High Strength Sintered Steels", *Modern Developments in Powder Metallurgy*, vol. 13, pp. 159–183.

*Primary Examiner*—Ngoclan Mai

*Attorney, Agent, or Firm*—Burns, Doane, Swecker & Mathis, L.L.P.

[57] ABSTRACT

The invention relates to the filed of powder metallurgy. A steel is disclosed, which is compacted from a powder mixture by means of pressure and heat, its microstructure arising mainly from two components, the first of which being austenitic (e.g., Hadfield manganese steel) and the second being an essentially martensitic component rich in hard precipitates. The austenitic microstructure is more ductile than the martensitic, and it effectively prevents the propagation of microscopic cracking. Thus, the material is suitable for use in wear parts subjected to strong forces, as in, e.g., stone crushers.

20 Claims, 1 Drawing Sheet

MAGNIFICATION 100x

MAGNIFICATION 100x

ABRASION RESISTANT, DUCTILE STEEL

FIELD OF THE INVENTION

The present invention relates to the field of powder metallurgy and to abrasion resistant steel grades. Particularly the invention is directed to steel suitable for manufacturing wear parts of stone crushers.

PRIOR ART

Wear parts of stone crushers are in use subjected to a strong abrasion and dynamic surface pressures due to the stone crushing. Stone, in this connection, refers to ore, mineral, concrete to be recycled or a corresponding material, as well as gravel. Correspondingly, stone crushers refer to cone, gyratory, jaw and roller crushers as well as vertical and horizontal impact hammer crushers and hammer crushers. Abrasion causes wear when the stone to be crushed microscopically cuts off material from the surface of the material. In addition, the surface of the wear part is subjected to forces causing microscopic fatigue and breakage due to the surface pressures caused by the stone crushing, which forces can lead to a strong loss of material and to wear. The wear caused by the microscopic fatigue and breakage is significant, especially, when the forces acting on the wear part are large or the toughness of the wear parts is low.

Hadfield manganese steels are wear part materials, the surface of which hardens by the effect of the surface pressures caused by the crushing. The abrasion resistance of the hardened surface is better than that of a surface that is not hardened, and the bulk of the wear part remains ductile due to the austenitic microstructure. Hadfield manganese steels are suitable for applications where a high toughness and a moderate abrasion resistance are required. They are not suitable for objects, where the surface pressures caused by the crushing do not make the surface harden.

High chromium cast irons, the so called white irons, are rich in chromium carbides mainly in a martensitic or austenitic matrix. They have an excellent abrasion resistance, but due to their low toughness, they can be used mainly in applications where the forces acting on the wear parts are small. In certain crusher applications, e.g. when crushing large stone material with impact hammer crushers, the lack of an abrasion resistant but sufficiently tough material leads to strong abrasion and high crushing costs.

SUMMARY OF THE INVENTION

The invention provides a powder metallurgical abrasion resistant material characterized in having a good abrasion resistance but simultaneously adequate ductility in order to prevent the macroscopic cracking of wear parts in use. The material in accordance with the present invention is produced by powder metallurgic methods, by compacting by means of temperature and pressure two or more separately manufactured powders into a compact material for wear parts. A combination of good ductile properties and abrasion resistance is obtained by mixing with each other powder qualities having different properties and thus producing, after the compacting, a material having a specifically better combination of the desired properties. The microstructure of the compact material preferably consists of a ductile austenitic steel (face centered cubic microstructure) and a mainly martensitic microstructure rich in hard precipitates such as carbides, nitrides and carbonitrides.

An austenitic microstructure has a better toughness than a martensitic one and it is the best one to prevent and stop the propagation of microscopic cracking, thus providing a structure that is more resistant to cracking. So, the material in accordance with the present invention, being more abrasion resistant, can be used without a risk of cracking also in wear parts subjected to strong forces. This was not possible using materials produced with traditional methods, like the above mentioned white iron.

DETAILED DESCRIPTION OF THE INVENTION

Figure 1:
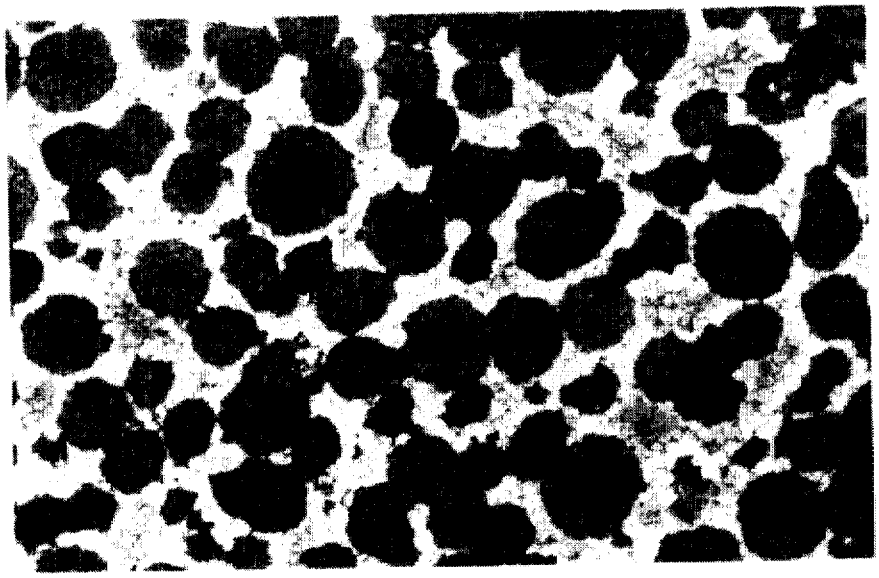
FIG. 1 is a photomicrograph at 100× of a compacted microstructure in accordance with the invention.

FIG. 1 illustrates an example of a compacted microstructure. The material was compacted by means of hot isostatic pressing at a temperature of 1180° C. and a pressure of 110 MPa for three hours and after that annealed at a temperature of 1100° C. for three hours, after which water quenching was carried out. The prealloyed powder had 50 volume percent Hadfield manganese steel powder (C 1.2 weight percent, Mn 11.0 weight percent, Cr 2.5 weight percent and V 0.4 weight percent, the balance being iron and residual impurities) and 50 volume percent high-speed steel powder (C 1.3 weight percent, Cr 4.15 weight percent, Mo 4.95 weight percent, V 3.0 weight percent, W 6.4 weight percent and Co 8.4 weight percent, balance iron and residual impurities).

The material in accordance with the present invention can include more than two different powders, but at least one of the powders to be used must be an iron based, essentially austenitic powder for improving the toughness, and one an iron based, martensitic powder including carbides, nitrides or carbonitrides for improving the abrasion resistance. In addition to the volume percentages of different powders, also the size distribution of the powders must be controlled in order to control the properties.

The material in accordance with the present invention can include several different powder blends, or in addition to the powder blend/blends, one or more separately produced powders having a uniform composition and partly or totally compact materials, whereby so called compound materials can be formed. This makes it possible to further improve the wear resistance and impact resistance of the materials and components. If more than one powder blend is used, the different powder blends must be separated from each other with thin sheets or foils. When a compact or partly compact material is used, it in not necessary to separate it from the powder blend.

Iron based martensitic powder including carbides, nitrides and carbonitrides should include enough alloying elements such as chromium or molybdenum in order to achieve an adequate hardenability and mainly a martensitic microstructure after the heat treatment.

In addition to martensite and precipitates, the powder might include a small amount of austenite. By alloying the powder in question adequately with e.g. chromium, molybdenum and vanadium in a suitable proportion, together with carbon and nitrogen, carbides, nitrides and carbonitrides can be incorporated into the microstructure for improving the abrasion resistance. The martensitic, precipitate-containing powder should include alloying elements forming carbides, nitrides and carbonitrides in an amount of at least 8 weight percent, most preferably from 10 to 20 weight percent and carbon and nitrogen at least 0.8 weight percent, most preferably from 1.8 to 3.6 weight percent. The nitrogen can be alloyed with the molten metal prior to atomization, during the gas atomization by using nitrogen as atomization gas or in a solid state by nitrifying the metal powder. The quantity of the precipitate-forming alloying elements should be selected based on the abrasion resistance required for the object in question.

The iron based austenitic powder should include enough known alloying elements for producing an austenitic microstructure at room temperature. This kind of alloying elements includes, among others, nickel, manganese, nitrogen and carbon. The austenitic iron based powder should most preferably be Hadfield manganese steel, the typical composition of which is from 0.5 to 1.8 weight percent of carbon, from 5 to 20 weight percent of manganese, the balance being iron and residual impurities. The Hadfield manganese steel can also include alloying elements forming carbides, nitrides and carbonitrides, such as chromium, molybdenum and vanadium, but not more than 10 weight percent, in order to prevent reduction of the toughness. Also other austenitic iron based powders, such as nickel alloyed austenitic powders can be used either together with the Hadfield manganese steel powder or alone.

The Hadfield manganese steel is, however, a preferable alternative because of its better abrasion resistance. The volume percentage of the austenitic iron based powder should be from 15 to 70 weight percent in order to assure adequate ductility. If the volume percentage is larger, the abrasion resistance decreases too much, and if the volume percentage is smaller, the adequate toughness is not obtained.

The particle size distribution of the powders should be selected so that the iron based austenitic microstructure would substantially form a matrix around the harder and more brittle martensitic, precipitate-containing microstructure areas and could in this way prevent the propagation of microscopic cracks. The martensitic, precipitate-containing microstructure areas should not be too large in order not to initiate too large micro cracks caused by impact loads. On the other hand, if the martensitic, precipitate-containing microstructure area is too small, the diffusion over the boundaries during processing reduces the quantity of the alloying, precipitate-forming elements and the quantity of precipitates, thus deteriorating the abrasion resistance.

Production of the material in accordance with the present invention preferably comprises the following phases:

production of separate powders by gas atomization and screening them to desired particle sizes (i) mixing of separate powders with each other in a suitable proportion (ii) filling the mixed powder or different prealloyed powders in a thin sheet mould (iii) evacuation of the container and closing it gas tight (iv) compacting the powder by means of heat and pressure to a substantially compact material (v) heat treatment Compaction of the powder blend can be implemented by well known methods, such as hot isostatic pressing, uniaxial compaction or other hot working methods. The compacting can also be implemented as a combination of different methods, e.g. by first producing an ingot by means of hot isostatic pressing, that is hot moulded by forging, rolling or extruding to a desired form.

During the production, the process temperature and pressure have to be adequate for compacting the material, but on the other hand, they should not bee too high, in order not to cause too much diffusion between the different powder species and deterioration of the properties. The processing temperatures should be, as well in compaction as in heat treatment, less than 1250° C., most preferably not exceeding 1125° C.

The properties of the material in accordance with the present invention can be adjusted to suit different purposes by control of the quantity, the composition and particle size distribution of the powders to be used. The following examples illustrate, how it is possible to affect the properties of the material by changing the powder qualities and their quantity. Example 1 shows, how the abrasion resistance is improved by increasing the portion of the martensitic, carbide-containing powder, but at the same time, the toughness is decreased, measured by a unnotched impact test. Example 2 shows, how the abrasion resistance of the material is improved by increasing the carbon content of the martensitic, carbide-containing powder and the content of the alloying elements forming carbides.

EXAMPLE 1

Influence of different volume percentages of powder on the impact toughness and abrasion resistance

| Hadfield-manganese steel powder % in volume | High-speed steel powder % in volume | Weight loss in abrasion test ASTM G 65 g | Impact toughness unnotched J |
|---|---|---|---|
| 100 | 0 | 1.10 | 150 |
| 65 | 35 | 0.92 | 56 |
| 50 | 50 | 0.83 | 23 |

Compacting the powders

Hot isostatic pressing at a temperature of 1180° C. and a pressure of 110 Mpa for 3 hours.

Heat treatment

Keeping at a temperature of 1100° C. for 3 hours, followed by water quenching

Chemical composition of the powders (weight percent)

| Hadfield manganese steel powder | | | |
|---|---|---|---|
| C | Mn | Cr | V |
| 1.2 | 11.0 | 2.5 | 0.4 |
| balance iron and residual impurities. | | | |

| High speed steel powder | | | | | |
|---|---|---|---|---|---|
| C | Cr | Mo | W | Co | V |
| 1.3 | 4.15 | 4.95 | 6.4 | 8.4 | 3.0 |
| balance iron and residual impurities | | | | | |

EXAMPLE 2

The influence of the alloying elements of the martensitic powder forming carbides on the abrasion resistance and impact toughness

| Hadfield-manganese steel powder % by volume | High-speed steel powder % by volume | Weight loss in abrasion test ASTM G 65 g | Impact toughness unnotched J |
|---|---|---|---|
| 65 | 35 type A | 0.92 | 56 |
| 65 | 35 type B | 0.47 | 18 |
| 50 | 50 type A | 0.83 | 23 |
| 50 | 50 type B | 0.43 | 23 |

Compacting the powders

Hot isostatic pressing in a temperature of 1180° C. and at a pressure of 110 Mpa for 3 hours.

Heat treatment

Keeping at a temperature of 1100° C. for 3 hours, followed by water quenching

Chemical composition of the powders (weight percent)

| Hadfield manganese steel powder | | | |
|---|---|---|---|
| C | Mn | Cr | V |
| 1.2 | 11.0 | 2.5 | 0.4 |
| balance iron and residual impurities. | | | |

| High speed steel powder A | | | | | |
|---|---|---|---|---|---|
| C | Cr | Mo | W | Co | V |
| 1.3 | 4.15 | 4.95 | 6.4 | 8.4 | 3.0 |
| balance iron and residual impurities | | | | | |

| High speed steel powder B | | | | | |
|---|---|---|---|---|---|
| C | Cr | Mo | W | Co | V |
| 2.3 | 4.15 | 7.1 | 6.4 | 10.5 | 6.4 |
| balance iron and residual impurities | | | | | |

We claim:

1. Powder metallurgical abrasion resistant material produced by mixing with each other two or more different powder qualities and by compacting by means of pressure and temperature into a compact material, wherein at least one of the powder qualities is an iron based face centered cubic powder and another of the powder qualities is an iron based substantially martensitic powder, said second powder including at least 0.8 weight percent carbon and nitrogen altogether and at least 8 percent alloying elements forming precipitates of carbides, nitrides, carbonitrides or mixtures thereof, the alloying elements including chromium, molybdenum, titanium, niobium, tantalum, tungsten, vanadium and mixtures thereof.

2. A material in accordance with claim 1, wherein the face centered cubic powder is of Hadfield manganese steel having 0.5 to 1.8 weight percent C, 5 to 20 weight percent Mn, up to 10 weight percent precipitate-forming alloying elements including Cr, Mo, Ti, Ta, Nb, W, V and mixtures thereof, balance iron and residual impurities or an iron based powder including sufficient Ni, Mn and N, so as to produce an austenitic microstructure.

3. A material in accordance with claim 1, wherein the iron based, substantially martensitic powder includes a total of 1.8 to 3.6 weight percent carbon and nitrogen, 6 to 16 weight percent vanadium and up to 12 weight percent of other precipitate-forming alloying elements including chromium, molybdenum, titanium, niobium, tantalum, tungsten and mixtures thereof, the balance being iron and residual impurities.

4. A material in accordance with claim 1, wherein the volume percentage of the iron based, face centered cubic powder is from 15 to 70 percent.

5. A material in accordance with claim 1, wherein the percentage in volume of the iron based, face centered cubic powder is from 30 to 50 percent.

6. A material in accordance with claim 1, wherein the average particle size of any powder present in an amount greater than 15 % by volume is less than 1000 micrometers.

7. A material in accordance with claim 1, wherein the average particle size of the iron based, face centered cubic powder is smaller than the average particle size of the iron based, substantially martensitic, precipitate-containing powder.

8. A material in accordance with claim 1, wherein the compact material has been prepared using a completely uncompacted powder blend or using at least one powder blend partly or completely consolidated together such that a compound structure is formed after compaction of said materials.

9. A material in accordance with claim 1, wherein the compact material has been prepared using one or more powder blends and at least one homogeneous powder which is not blended with another powder, and such that a compound structure is formed after compaction.

10. A material in accordance with claim 1, wherein the compact material has been prepared by means of the simultaneous action of pressure and temperature.

11. A material in accordance with claim 1, wherein the temperatures used for compacting and heat treating the powder do not exceed 1250° C.

12. A material in accordance with claim 1, wherein the compact material comprises wear parts of stone crushers.

13. A material in accordance with claim 1, wherein the compact material comprises impact hammer crushers.

14. A material in accordance with claim 2, wherein the iron based, substantially martensitic powder includes a total of 1.8 to 3.6 weight percent carbon and nitrogen, 6 to 16 weight percent vanadium and up to 12 weight percent of other precipitate-forming alloying elements including chromium, molybdenum, titanium, niobium, tantalum, tungsten and mixtures thereof, the balance being iron and residual impurities.

15. A material in accordance with claim 2, wherein the volume percentage of the iron based, face centered cubic powder is from 15 to 70 percent.

16. A material in accordance with claim 3, wherein the volume percentage of the iron based, face centered cubic powder is from 15 to 70 percent.

17. A material in accordance with claim 14, wherein the volume percentage of the iron based, face centered cubic powder is from 15 to 70 percent.

18. A material in accordance with claim 2, wherein the percentage in volume of the iron based, face centered cubic powder is from 30 to 50 percent.

19. A material in accordance with claim 2, wherein the average particle size of any powder present in an amount greater than 15 % by volume is less than 1000 micrometers.

20. A material in accordance with claim 2, wherein the average particle size of the iron based, face centered cubic powder is smaller than the average particle size of the iron based, substantially martensitic, precipitate-containing powder.

* * * * *